US012540773B2

(12) United States Patent
Frankie

(10) Patent No.: US 12,540,773 B2
(45) Date of Patent: Feb. 3, 2026

(54) LIQUIFIED NATURAL GAS PROCESSING COLD BOX WITH INTERNAL REFRIGERANT STORAGE

(71) Applicant: Brian Frankie, Missouri City, TX (US)

(72) Inventor: Brian Frankie, Missouri City, TX (US)

( * ) Notice: Subject to any disclaimer, the term of this patent is extended or adjusted under 35 U.S.C. 154(b) by 369 days.

(21) Appl. No.: 17/446,727

(22) Filed: Sep. 2, 2021

(65) Prior Publication Data

US 2023/0076753 A1 Mar. 9, 2023

(51) Int. Cl.
*F25J 1/00* (2006.01)
*F25J 1/02* (2006.01)

(52) U.S. Cl.
CPC ..... *F25J 1/0087* (2013.01); *F25J 1/0258* (2013.01); *F25J 2215/60* (2013.01); *F25J 2215/62* (2013.01)

(58) Field of Classification Search
CPC ..... F25J 1/0087; F25J 1/0258; F25J 1/0259; F25J 1/0275; F25J 1/0288; F25J 1/0022; F25J 1/0284; F25J 2215/60; F25J 2215/62
See application file for complete search history.

(56) References Cited

U.S. PATENT DOCUMENTS 4,856,290 A * 8/1989 Rodda ..... F25B 45/00 62/149
5,505,232 A 4/1996 Barclay
6,155,078 A 12/2000 Miyashita et al.
7,146,817 B2 12/2006 Baudat
7,340,921 B2 3/2008 Cote et al.
2004/0069015 A1* 4/2004 Paradowski ..... F25J 3/0219 62/620
2005/0183452 A1* 8/2005 Hahn ..... F25J 1/0022 62/620
2006/0254311 A1 11/2006 Billy et al.
2008/0184735 A1* 8/2008 van Wijngaarden . F17C 13/001 62/613
2015/0253070 A1* 9/2015 Davies ..... F25J 1/004 62/50.1
2017/0115043 A1* 4/2017 Laughman ..... F25B 49/02
2019/0137171 A1 5/2019 Barclay et al.
2019/0353304 A1* 11/2019 Franklin ..... B60K 15/077
2020/0316521 A1* 10/2020 Pess ..... A62C 3/065
2021/0063082 A1* 3/2021 Gallinelli ..... F25J 1/0268

FOREIGN PATENT DOCUMENTS

CN 111964354 A * 11/2020 ..... F25J 3/069

* cited by examiner

*Primary Examiner* — Frantz F Jules
*Assistant Examiner* — Webeshet Mengesha
(74) *Attorney, Agent, or Firm* — Sheri Higgins Law, PLLC; Sheri Higgins

(57) ABSTRACT

A system for processing liquified natural gas can include: a natural gas feed; a cold box; one or more natural gas cooling components; and a storage tank configured to store a refrigerant, wherein the one or more natural gas cooling components and the storage tank are located within the cold box. The cold box can be a methane cold box and the refrigerant can be propane, ethane, or ethylene. The system can also include a propane refrigerant cycle and/or an ethylene refrigerant cycle. Refrigerant stored in the methane cold box can be used to replenish refrigerant lost in the propane/ethylene cycles. The cold box can be an ethylene cold box of the ethylene refrigerant cycle. Propane can be stored in the ethylene cold box. A second storage tank can be located within a methane cold box and store ethane or ethylene.

20 Claims, 5 Drawing Sheets

LIQUIFIED NATURAL GAS PROCESSING COLD BOX WITH INTERNAL REFRIGERANT STORAGE

TECHNICAL FIELD

Natural gas can be processed into liquified natural gas ("LNG) via a variety of processes that decrease the temperature of the natural gas to produce a liquified natural gas. Some processes utilize a cold box. Refrigerants required by LNG processes can be stored inside tanks that are located within the cold box.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
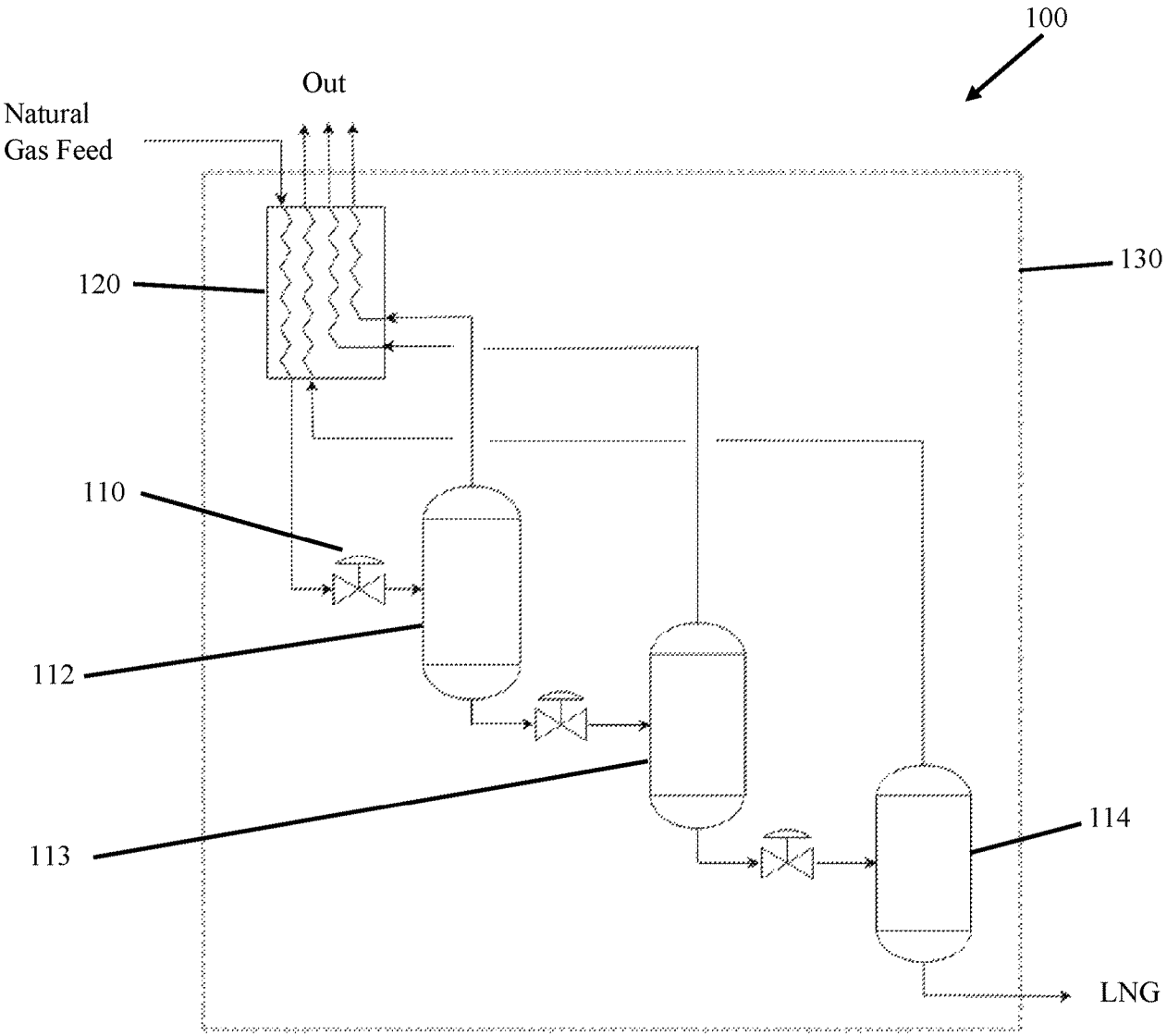
FIG. 1 is a diagram of a liquified natural gas processing system according to certain embodiments.

Natural gas, composed primarily of methane, can be used in a variety of applications, such as in homes and buildings as a source of heat. However, for storage and transportation purposes, methane in a gas state occupies a large volume and can require very large storage or transportation tanks. Accordingly, natural gas can be processed into a liquid state called liquified natural gas ("LNG"). LNG occupies about $1/600^{th}$ the volume of natural gas in the vapor state, thereby allowing more methane to be stored and transported in a tank of a given volume. LNG is also used as a fuel alternative to gasoline for vehicles. If LNG is to be used as an energy source, for example in homes or buildings, the LNG can be converted back into a vapor state.

There are a variety of ways to process methane gas into a liquid state. All processes involve cooling methane gas to the temperature at which the gas becomes a liquid—typically around −160° C. (−256° F.). The LNG process typically uses hydrocarbon refrigerants (e.g., propane and ethane or ethylene) in one or more vapor compression cycles. Although the refrigerant cycles are closed processes, small amounts of refrigerant vent or leak; for example, through compressor seals or depressurization after shutdown and before restart. Therefore, a processing facility will commonly have refrigerants stored in pressurized containers at the facility to replace these losses.

There are several hazards and disadvantages for refrigerant storage. For example, risk analysis reveals that refrigerant storage is among the most hazardous areas at LNG facilities because the refrigerants are highly volatile, combustible, and are stored under pressure. Propane has a molecular weight heavier than air, while ethane and ethylene have approximately the same molecular weight as air but have a higher density than air when released from storage. The combination of high vaporization rates, high combustibility, and high density can cause a very large, low, pooling cloud of vapor from a leak that can creep over the ground and can find ignition sources. If the leaked vapor finds an ignition source, then a flame can rapidly propagate back to the source of the leak. Once the flame impinges on the pressurized storage container, it will cause the stored refrigerant to heat up and boil. If the storage container mechanically fails and explodes due to the heat and pressure, a resulting boiling liquid expanding vapor explosion ("BLEVE") event can destroy large areas of the processing facility and can even cause mass casualties. Some of the worst hydrocarbon explosion events, with hundreds or thousands of casualties, have been caused by BLEVEs from stored ethane and propane; for example, in 1984 in Mexico City, Mexico, and in 1978 in Tarragona, Spain.

Previous efforts to reduce the risk of hazards at LNG facilities to an acceptable level include placing the refrigerant storage containers within a dedicated plot area that is physically distant from other areas of the facility where personnel are continually present or that contain other flammable materials. Some safety measures that have been incorporated into the design of the facilities and the refrigerant storage plot area can include pressure relief, emergency isolation and depressurization, spacing requirements, storage vessel orientation, fire and gas detection equipment, fire monitors, water deluge/curtains, fire protection insulation, firewalls, and spill-impoundment areas.

Accordingly, the requirements for refrigerant storage can result in a complex and expensive processing facility. By way of example, the refrigerant storage area typically requires as much plot area as possible in order to provide adequate spacing and set off distances from other areas of the processing facility. This space is often difficult to come by in facilities with limited available area, particularly in offshore facilities. The refrigerant storage area is also frequently the primary determinant for the overall maximum water demand for fire eradication at facilities. Despite these efforts to improve the safety of refrigerant storage areas, the residual risk profile of possible refrigerant leaks often dominates the overall risk to the facility and workers. Therefore, there is a long-felt need and an ongoing industry concern for improved LNG processing facility systems that reduce the risk of fires and explosions and decrease the acreage needed.

It has been discovered that LNG processes that utilize cold boxes for the refrigeration processes can house the refrigerant storage tanks within the cold box. There are several advantages of the various embodiments disclosed. The primary advantage is that the refrigerants may be stored at temperatures lower than ambient temperature and at pressures very close to ambient pressure. Because the refrigerant vapor pressure is much lower than ambient pressure at the temperatures inside the cold box, the refrigerant storage tanks can use a lower design pressure and can cost less compared with traditional refrigerant storage tanks at ambient temperature. Ethane or ethylene are typically stored in refrigerant storage tanks at LNG facilities at elevated pressure and at temperatures slightly below ambient temperature. A typical temperature, for example, is in the range of −20° C. to −40° C. (−4° F. to −40° F.), with a resulting pressure generated from the refrigerant vapor on the order of 10 to 20 bar. Because the stored liquid is slightly cryogenic, any heat leak into the storage tanks will increase the pressure within the tanks and requires intermittent venting to prevent pressure accumulation and eventual overpressure. By storing the refrigerants inside the cold box at temperatures below the normal ambient pressure boiling point (e.g., about −89° C. (−128.2° F.) for ethane) eliminates the potential for pressure accumulation and the loss of stored refrigerant from venting.

Another significant advantage is that by providing a storage tank for storing refrigerants at near-ambient pressure eliminates the possibility of a BLEVE. For a BLEVE to occur, high-pressure refrigerant storage tanks require significant internal heat and pressure buildup prior to rupturing of the tank, and a low-pressure tank designed for ambient pressure simply cannot accumulate enough energy for the most destructive forms of explosions. Additionally, because the storage tanks are located within the cold box, the tanks are protected from external forces that can cause failure. By way of example, the cold box and insulation within the cold box provides significant protection against fire impingement as well as mechanical impingement from external projectiles, thereby reducing the risks associated with the stored flammable refrigerants. Moreover, any small vapor leaks from the stored refrigerant can be contained within the cold box and can be detected by a standard cold box inert purge, vent, and detection system, effectively providing secondary containment of modest leaks. This can eliminate a major source of process risk to tanks that are located outside of a cold box.

Another advantage is a cost savings due to a higher density of stored refrigerant. The density of refrigerants at the cold box cryogenic temperatures is significantly higher compared to the density of refrigerants stored at traditional temperatures. For example, propane stored at −160° C. (113 K) has a density 40% higher (or more dense) than propane stored at 15° C. (288 K). Reducing the required storage volume of the storage tanks for the same quantity of refrigerant by 40%, for example, can provide significant cost savings. Another significant cost savings is eliminating a large, separate refrigerant storage area from the LNG processing facility. This can significantly reduce the total acreage needed for the LNG processing facility.

A system for processing liquified natural gas can include: a natural gas feed; a cold box; one or more natural gas cooling components; and a storage tank configured to store a refrigerant, wherein the one or more natural gas cooling components and the storage tank are located within the cold box.

The LNG processing system includes a natural gas feed. The natural gas can be methane. The natural gas can also include ethane or other compounds. The natural gas in the natural gas feed is at near-ambient temperature (24° C. (75° F.)) and at an elevated pressure generally in the range of 30 to 90 bar. The natural gas in the natural gas feed can be cooled to a temperature less than 24° C. (75° F.) for example. The natural gas can be cooled using one or more refrigeration cycles (discussed in more detail below).

The LNG processing system also includes a cold box. The LNG processing system can use any type of process that processes LNG using a cold box. The cold box can be an enclosure that is airtight or mostly airtight. Externally, the cold box can be a cube, or rectangular cuboid, with a leak-tight carbon-steel enclosing frame, filled with the required processing equipment, piping, and loose-fill insulation, including but not limited to expanded perlite. The cold box can be maintained slightly above atmospheric pressure (i.e., >1 atmosphere), for example, in the range of 1.01 atm-1.10 atm. The cold box can be constructed in a remote fabrication yard. The cold box can be fitted with cryogenic flanged terminations to enable simple on-site hookup to facility process pipework without intensive field construction.

The cold box can have dimensions that are selected based on the specific type of LNG processing. The cold box can be made from a variety of materials known to those skilled in the art. The cold box can further include a loose-filled insulating material that insulates the components inside the cold box against increases in temperature. The cold box can be purged with a constant, low pressure, dry, inert gas (for example, nitrogen gas) to prevent air and water vapor ingress. The cold box can further include an inert gas inlet and a vent.

Figure 2:
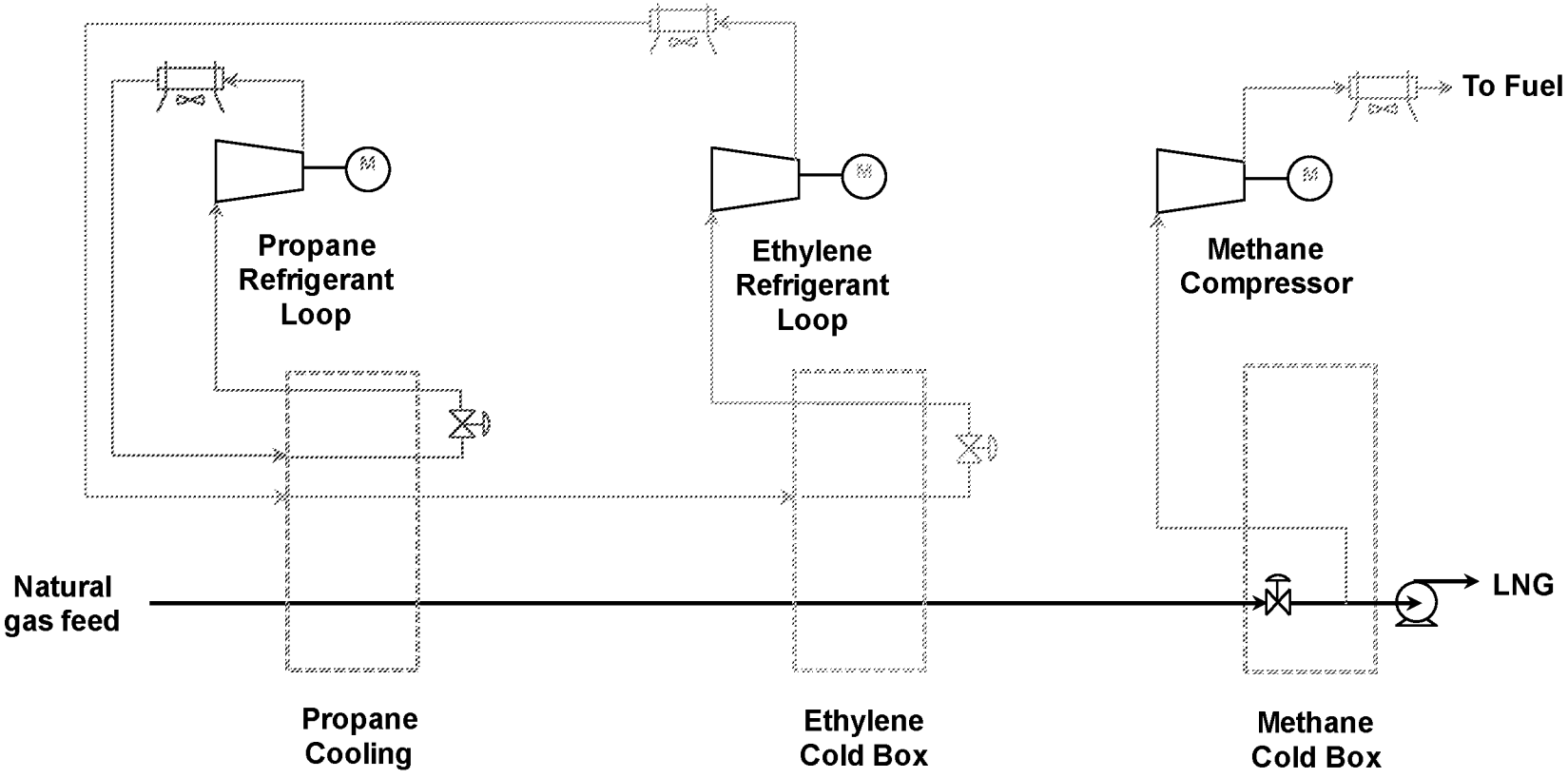
FIG. 2 is a diagram of a liquified natural gas processing system according to certain embodiments.

Turning to the figures, the cold box can be a methane cold box 130 as shown, for example, in FIG. 1. The cold box can also be an ethylene cold box, for example, as shown in FIG. 2 (discussed below). In order to process the natural gas into LNG, the natural gas from the natural gas feed must be cooled to at least the temperature at which the gas becomes a liquid—typically a temperature of −160° C. (−256° F.) when it is near atmospheric pressure. The system includes one or more natural gas cooling components for processing LNG. The one or more natural gas cooling components can be included in the methane cold box 130 as shown in FIG. 1.

As shown in FIG. 1, the one or more natural gas cooling components can include a heat exchanger 120 and one or more flash vessels. Any of the cooling components can be wrapped with insulation. Wrapped insulation can be used in addition to or in lieu of loose-filled insulation in the cold box 130. Natural gas can enter the heat exchanger 120 from the natural gas feed and flow into a first flash vessel 112 via a pressure reduction device, such as a valve 110. The first flash vessel 112 vents vapor out of the top of the vessel and into the heat exchanger 120, which causes a drop in pressure within the first flash vessel 112 and decreases the temperature of the natural gas. The natural gas can then flow into a second flash vessel 113 whereby vapor is vented out of the top of the vessel into the heat exchanger 120, which causes another drop in pressure and further decreases the temperature of the natural gas. The series can continue with a third flash vessel 114, a fourth flash vessel (not shown), and so on as required until the temperature of the natural gas is lowered to the liquid storage temperature for the LNG product. One of ordinary skill in the art will be able to design the one or more natural gas cooling components, including their dimensions, materials, connections, spacing, etc., in order to produce LNG. The vapor from the flash vessels that enters the heat exchanger 120 can flow out of the heat exchanger 120 to a methane compressor shown in FIG. 2.

As discussed above, the natural gas in the natural gas feed can be cooled prior to entering the methane cold box. One non-limiting example of a process that utilizes a cold box is called a pure component cascade process. FIG. 2 is a diagram of one non-limiting example of the LNG processing 100 system utilizing a pure component cascade process. The cascade process can have a series of pure component refrigeration cycles in cascading temperature arrangements. A first part of the pure component cascade can be a propane cycle that is typically called the "precooling refrigerant." A second part of the pure component refrigeration cascade can be an ethylene cycle that is typically called the "liquefaction refrigerant." A third part of the pure component refrigeration cascade can be the methane cycle and can be either closed or open as shown in FIG. 1. The methane cycle is typically called the "subcooling cycle" if it is a closed-refrigeration cycle, or the "methane cycle" if it is an open-refrigeration cycle as shown in FIG. 1. It is to be understood that other processes exist that utilize a cold box for processing LNG in addition to a pure component cascade process and the embodiments are meant to include these other processes.

As can be seen, the LNG processing 100 system can include a propane refrigerant loop and propane cooling equipment. The refrigerant, propane, can flow through a closed-loop vapor compression refrigeration cycle. In this cycle, propane vapor is compressed to high pressure and condensed against a cooling medium, e.g., air or water. The high-pressure liquid propane is expanded to lower pressure, and the resulting cold, low-pressure liquid propane provides refrigeration in one or more heat exchangers to the desired high temperature process stream(s)—for example, as shown in FIG. 2 to the natural gas feed and high-pressure ethylene vapor stream. As the propane provides refrigeration, it boils and the vapor is sent back to the suction of a compressor to start the cycle again. The LNG processing 100 system can further include more than one refrigerant cycle; for example, an ethylene refrigeration liquefaction cycle as shown in FIG. 2. The LNG processing 100 system can also use alternate refrigerant cycles, such as an ethane cycle, or one or more mixed-component refrigerant cycles. The refrigerant cycles can be arranged from warmest to coolest such that the natural gas flows through each refrigerant cycle in a cascade series. Preferably, the refrigerant cycles are arranged such that the natural gas flows through the natural gas feed towards the methane cold box of the LNG processing 100, reaching successively lower temperatures in each refrigerant cycle. By way of example, the natural gas can first flow through propane cooling equipment, then through an ethylene cold box, and then into the methane cold box for processing. The temperature of the natural gas stream shown in FIG. 2 can be, for example, about 25° C. (77° F.) prior to inlet into the propane cooling system, about −35° C. (−31° F.) between the propane cooling and ethylene cold box, about −90° C. (−130° F.) between the ethylene and methane cold boxes, and about −160° C. (−256° F.) upon exiting the methane cold box. Additional components of the refrigerants used in the pre-cooling or liquefaction cycles can include butanes, propylene, methane, nitrogen, ammonia, or combinations thereof.

Figure 3:
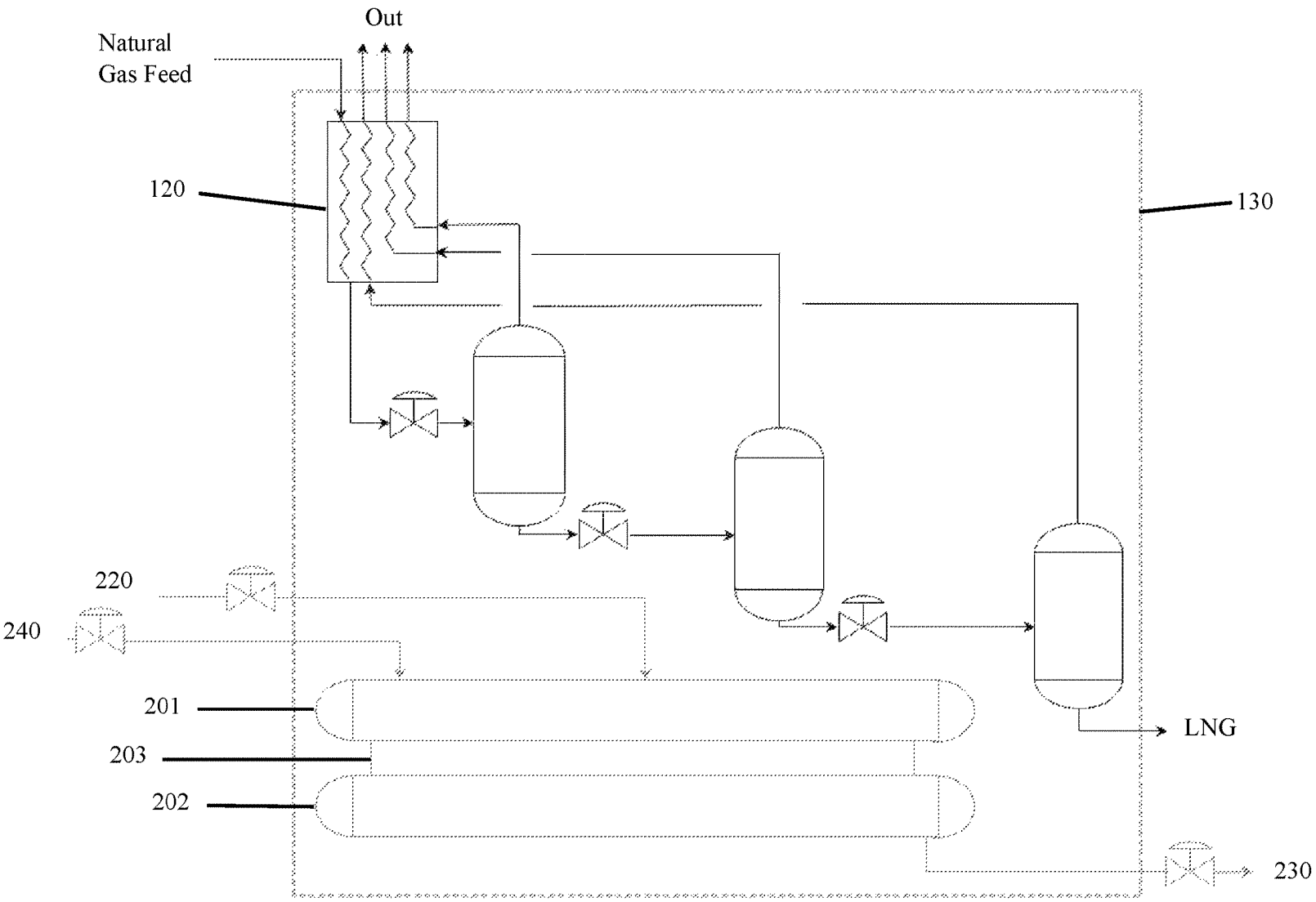
FIG. 3 is a diagram of the LNG processing system of FIG. 1 with refrigerant storage tanks located within a methane cold box according to certain embodiments.

The system also includes a storage tank configured to store a refrigerant, wherein the storage tank is housed within the cold box. According to a first example, the storage tank can be housed within a methane cold box. FIG. 3 shows the methane cold box 130 of FIG. 1 with a first storage tank 201 and a second storage tank 202 housed within the methane cold box 130. Although shown with two storage tanks, it is to be understood that the system can include just one storage tank or more than two storage tanks. The storage tank is configured to store a refrigerant. The refrigerant can be the refrigerant used for the propane and/or ethylene refrigerant cycles. For example, the refrigerant can be propane, ethane, or ethylene. The storage tank can be made from a variety of materials suitable for the temperatures and pressures required, including, but not limited to, stainless steel, nickel steel, or aluminum.

If more than one storage tank is included, then the first storage tank 201 and the second storage tank 202 (and any other storage tanks) can be oriented on top of each other or side by side. A fluid communicator connector 203 can connect the first and second storage tanks 201/202 such that fluid communication and pressure communication occurs between the tanks. The fluid communicator connector 203 can be used when the same type of refrigerant (e.g., propane) is stored within both the first and second storage tanks 201/202. FIG. 3 shows the same type of refrigerant being stored within the first and second storage tanks 201/202. A fluid communicator connector 203 may not be needed when a different type of refrigerant is stored in different tanks; for example, propane in the first storage tank 201 and ethane in the second storage tank 202.

The system can include a refrigerant fill line 220. The refrigerant fill line 220 can be used to replace the refrigerant to a desired volume. If the storage tanks store different types of refrigerants, then each type of refrigerant storage tank can have its own refrigerant fill line 220. The system can also include an inert gas inlet 240. An inert gas (for example, nitrogen gas) can be supplied to the first and second storage tanks 201/202 via the inert gas inlet 240 to pressurize the first and second storage tanks 201/202 to a desired pressure, which can eliminate the possibility of operating the storage tanks in vacuum conditions and can provide a driving force for draining the refrigerant from the storage tanks. According to any of the embodiments, the first storage tank 201 and any other storage tanks are designed to withstand a desired internal pressure; for example, in excess of the inert gas supply pressure. The desired pressure can be, for example, 10 Bar (1 megapascal) or other pressure as required by the system. As with the refrigerant fill line 220, more than one inert gas inlet 240 may be needed if a different type of refrigerant is stored within the storage tanks.

The system can also include a refrigerant drain line 230. The refrigerant drain line 230 can be connected to a series of storage tanks that store the same type of refrigerant, or there can be a refrigerant drain line 230 for each storage tank or series of storage tanks for each type of refrigerant. The refrigerant being stored in the storage tank(s) can flow out of the storage tank via the refrigerant drain line 230. The first storage tank 201, the second storage tank 202, or any of the storage tanks can be slightly sloped towards the refrigerant drain line 230 to allow complete drainage of the refrigerant from the tank(s).

The storage tank can also be housed within an ethylene cold box that is shown in FIG. 2 in addition to, or instead of, a methane cold box. According to this embodiment, the methane cold box as shown in FIG. 3 may not house a storage tank. It is to be understood that the discussion of the storage tank, refrigerant fill line, refrigerant drain line, etc. is meant to apply to any of the embodiments disclosed regardless of the cold box used to house the storage tank. The one or more natural gas cooling components can be the components of the ethylene refrigeration liquification cycle and the ethylene cold box. The storage tank can be housed within any cold box utilized in LNG processing instead of a methane or ethylene cold box.

In a pure component cascade process as discussed above with reference to FIG. 2, enthalpy is released from the ethylene cold box and the methane cold box during the liquification cycle and each successive transfer to the next flash vessel and decreases the temperature of the LNG being processed. Accordingly, the internal temperature of the methane cold box 130 for the embodiment shown in FIG. 2 can range from −90° C. to −160° C. (−130° F. to −256° F.). Having the first storage tank 201 and any other refrigerant storage tanks housed within the cold box 130 allows the storage tank to benefit from the cold box internal temperature; thereby substantially reducing or eliminating hazards and risks associated with storage tanks located outside of the cold box exposed to ambient temperature. According to any of the embodiments, the refrigerant is stored in the storage tank inside the cold box at a temperature less than the boiling point of the refrigerant at 1 atm but above the refrigerant melting point. A colder storage temperature (for example, within the methane and/or ethylene cold box) can reduce the vapor pressure of the refrigerants, which decreases loss of vapor and also increases the density of the refrigerant, which reduces the refrigerant volume and required dimensions of the storage tank in order to store the desired mass of refrigerant. Table 1 lists properties for refrigerants.

TABLE 1

| Refrigerant | Boiling point at 1 atm Deg K (° C.) | Melting point Deg K (° C.) | Density @113K ($kg/m^3$) | Vapor pressure @113K (bar) |
|---|---|---|---|---|
| Propane | 231 (−42) | 85 (−188) | 705 | <0.000001 |
| Ethane | 184 (−89) | 90 (−183) | 627 | 0.001 |
| Ethylene | 169 (−104) | 104 (−169) | 643 | 0.006 |

According to any of the embodiments, the first storage tank 201 and any other storage tanks are thermally coupled to each other and at least one of the one or more natural gas cooling components. According to any of the embodiments, the storage tank is thermally coupled to the coldest gas cooling component (for example, the third flash vessel 114 shown in FIG. 1), which will inherently be the coldest flash vessel if three flash vessels are used. The thermal coupling can be a convection connection. One example of a convection connection is to include a tunnel in loose-filled insulation that allows thermal migration between a flash vessel and the storage tank(s). The thermal coupling can also be conductive connection. By way of example, a thermally conductive material such as copper or aluminum can physically connect the flash vessel to the storage tank(s). By way of another example, a thermally conductive material, such as steel, can be used as a support for a flash vessel and the storage tank wherein at least a portion of the support thermally couples the storage tank to the flash vessel. For a conductive connection, an insulating material can be wrapped around all or a portion of the outside of the storage tank. There can also be both a convection and a conductive connection between the one or more natural gas cooling components and the storage tank. In this manner, the refrigerant is stored within the storage tank at much lower temperatures compared to storage tanks located outside of the cold box. This lower temperature can decrease the vapor pressure of the refrigerant, thereby reducing the pressure in the storage tank, and increase the density of the refrigerant, thereby decreasing the dimensions of the storage tank.

Figure 4:
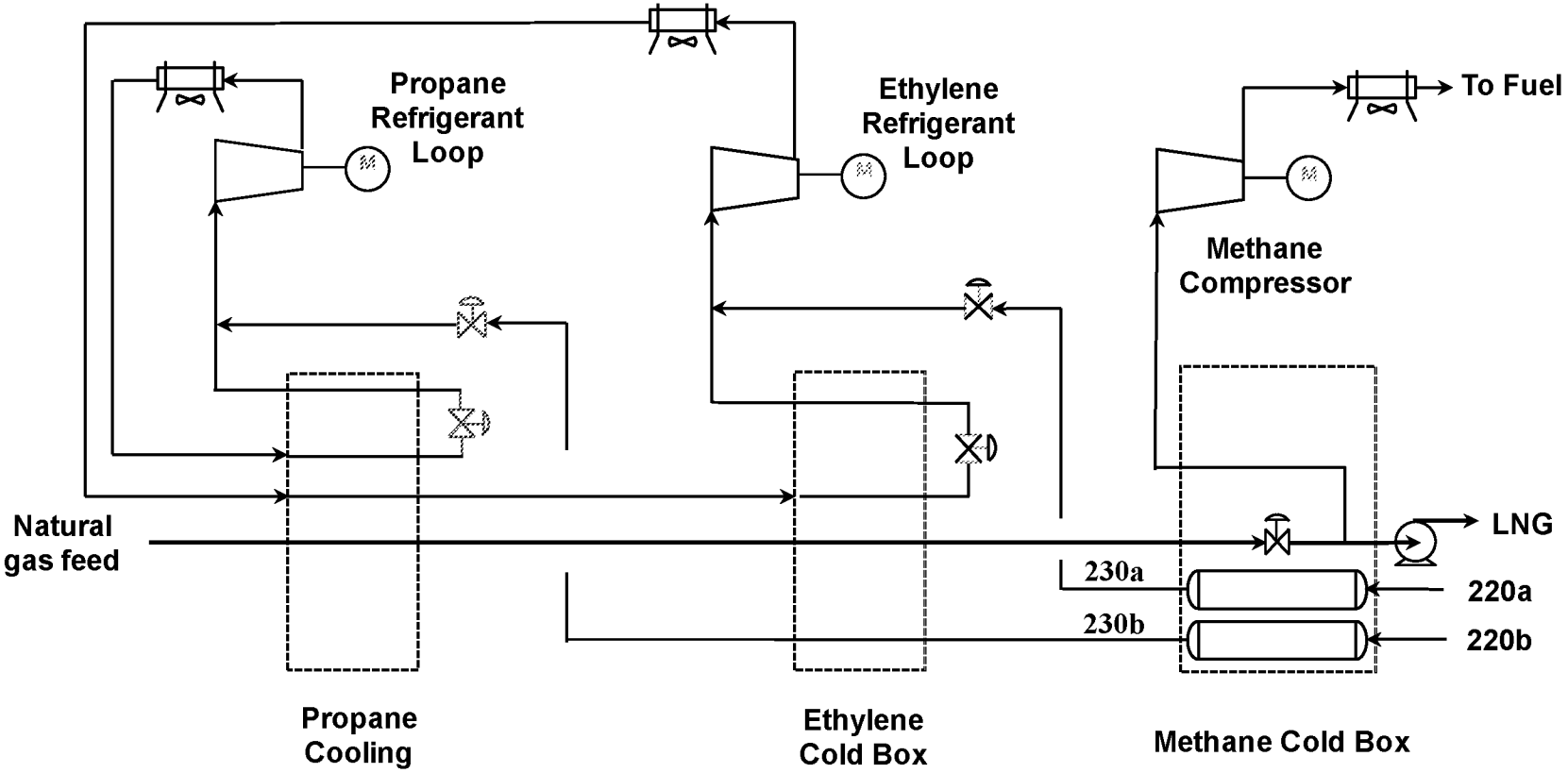
FIG. 4 is a diagram of FIG. 2 showing refrigerant drain lines and refrigerant fill lines according to certain embodiments.

FIG. 4 is a diagram of the LNG processing 100 system with the first and second storage tanks 201/202 (not labeled) housed within the methane cold box. As can be seen, the first storage tank can include a first refrigerant fill line 220*a* and a first refrigerant drain line 230*a* and can store a first type of refrigerant, for example, ethylene as shown. The second storage tank can include a second refrigerant fill line 220*b* and a second refrigerant drain line 230*b* and can store a second type of refrigerant, for example propane as shown. The refrigerants can flow into their respective refrigerant loop—propane into the propane refrigerant loop and ethane or ethylene into the ethylene refrigeration liquification cycle. If a particular refrigerant cycle or loop loses refrigerant due to, for example, minor leaks or a complete system shutdown with purging, then the refrigerant cycles can be replenished with refrigerant from the storage tanks. As the volume of refrigerant stored in the storage tank is reduced by replenishing the refrigerant cycle, more refrigerant can be added to the storage tank via the refrigerant fill line 220*a* and/or 220*b*. It is to be understood that if, for example, there are 3 types of refrigerants and 3 separate refrigerant cycles, then there would be at least 3 storage tanks (one for each type of refrigerant), 3 separate refrigerant fill lines, and 3 separate refrigerant drain lines that correspond to the 3 separate refrigerant cycles. As can also be seen in FIG. 4, a fluid communicator connector 203 is not included because the first storage tank 201 stores a different type of refrigerant than the second storage tank 202.

Figure 5:
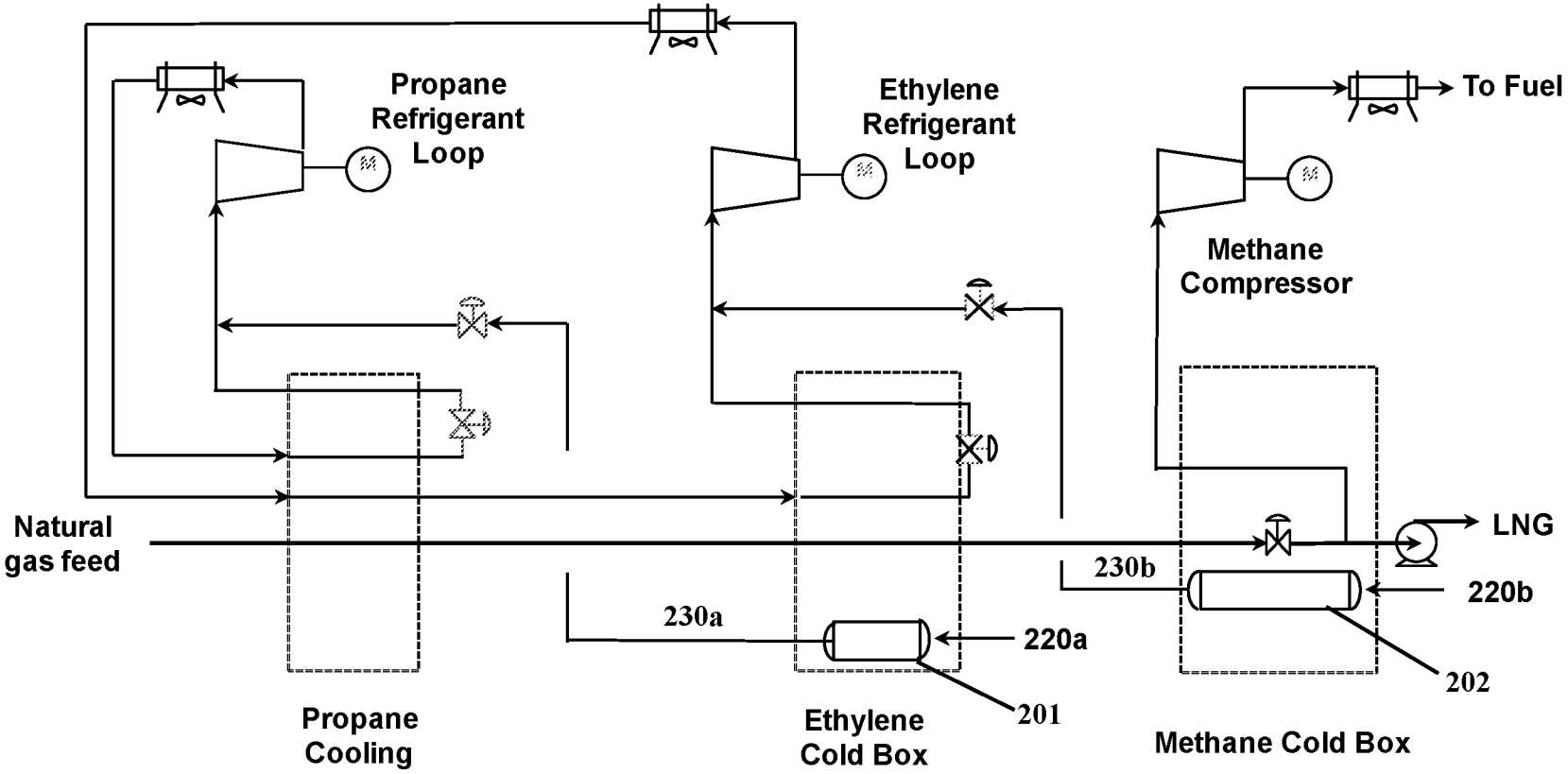
FIG. 5 is a diagram showing an LNG processing system having a first storage tank located within an ethylene cold box and a second storage tank located within a methane cold box according to certain embodiments.

FIG. 5 is a diagram of the LNG processing 100 system according to certain other embodiments. According to these embodiments, there can be a first storage tank 201 housed within the ethylene cold box and a second storage tank 202 housed within the methane cold box. According to this embodiment, the first storage tank 201 can store a refrigerant of propane, and the second storage tank 202 can store a refrigerant of ethane or ethylene. The specific cold box used to house the storage tank, as well as the refrigerant that is stored within the storage tank, can be selected based on the specifics of the LNG processing system and the desired temperature at which the refrigerant is optimally stored. By way of example, propane that is used in the propane pre-cooling refrigerant cycle can be stored at a temperature greater than the desired storage temperature of ethane or ethylene. Accordingly, the ethylene cold box can provide the desired storage temperature for propane refrigerant while the methane cold box can provide the desired storage temperature for ethane or ethylene refrigerant. The first refrigerant can be replenished via a first refrigerant fill line 220*a* and the first refrigerant can flow into the propane refrigerant loop via a first refrigerant drain line 230*a*. The second refrigerant can be replenished via a second refrigerant fill line 220*b* and the second refrigerant can flow into the ethylene refrigerant loop via a second refrigerant drain line 230*b*.

The dimensions of the first storage tank 201 and any other storage tanks can be selected such that a desired mass of refrigerant is stored within the storage tank. The desired mass can be 1 to 2 times the mass needed to fill the corresponding refrigerant cycle. By way of example, if a propane refrigerant cycle utilizes 500 tonnes of propane, then the first storage tank 201 for propane can be in the range of 500 to 1,000 tonnes. In this manner, if all of the propane in the refrigerant cycle needs to be purged, then there is sufficient propane stored in the first storage tank 201 to fill the refrigerant cycle. The volume of the storage tank can be calculated based on the required mass of refrigerant divided by the density at the refrigerant storage temperature. The storage tank can have a small amount of volume reserved for vapor space above the stored liquid refrigerant. For example, the storage tank can include 95% of the volume reserved for liquid refrigerant and 5% for vapor space. Other percentages can be selected based on the specifics of the LNG processing 100 system.

The LNG processing 100 system can include a variety of other components. The other components can include but are not limited to: instrumentation for monitoring temperatures, pressure, leaks, and flow rates; control systems, including flow control valves and flow meters; inert gas controllers for the cold box and storage tank, including inlets and vents; and safety systems, including relief valves. Another component that can be included in the system is a pre-cooler for the refrigerant fill line 220. In this manner, the refrigerant can flow into the storage tank at a temperature less than the temperature outside the cold box and reduce or eliminate an increase in the internal temperature of the cold box. The refrigerant in the fill line can be pre-cooled using a small slip stream of the produced LNG. Another component that can be included in the system is a warmer for the refrigerant in the refrigerant drain line 230. The warmer can be a mechanical heater or an external heat exchanger; for example, a slip stream of natural gas from the natural gas feed that increases the temperature of the refrigerant in the drain line prior to flowing into the refrigerant loops.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention.

As used herein, the words "comprise," "have," "include," and all grammatical variations thereof are each intended to have an open, non-limiting meaning that does not exclude additional elements or steps. While compositions, systems, and methods are described in terms of "comprising," "containing," or "including" various components or steps, the compositions, systems, and methods also can "consist essentially of" or "consist of" the various components and steps. It should also be understood that, as used herein, "first," "second," and "third," are assigned arbitrarily and are merely intended to differentiate between two or more storage tanks, fill lines, drain lines, etc., as the case may be, and do not indicate any sequence. Furthermore, it is to be understood that the mere use of the word "first" does not require that there be any "second," and the mere use of the word "second" does not require that there be any "third," etc.

Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent(s) or other documents that may be incorporated herein by reference, the definitions that are consistent with this specification should be adopted.

What is claimed is:

1. A system for processing liquified natural gas comprising:

a natural gas feed;

a cold box;

one or more natural gas cooling components, wherein the one or more natural gas cooling components are part of a refrigerant cycle;

a refrigerant, wherein a mass of the refrigerant is required to fill the refrigerant cycle; and a storage tank configured to store the refrigerant, wherein the one or more natural gas cooling components and the storage tank are located within the cold box, wherein the storage tank is thermally coupled to the one or more natural gas cooling components whereby the refrigerant is stored at a temperature below its boiling point when at a pressure of 1 atmosphere, and has a volume such that a mass of the refrigerant stored in the storage tank is greater than or equal to the mass of the refrigerant required to fill the refrigerant cycle.

2. The system according to claim 1, wherein the cold box is a methane cold box.

3. The system according to claim 2, wherein the one or more natural gas cooling components are selected from the group consisting of a heat exchanger, one or more flash vessels, and combinations thereof.

4. The system according to claim 3, wherein the system further comprises a methane compressor, and wherein a vapor from the one or more flash vessels can enter the methane compressor.

5. The system according to claim 1, wherein the refrigerant cycle is an ethylene refrigerant cycle comprising an ethylene cold box.

6. The system according to claim 5, wherein the refrigerant cycle is a propane refrigerant cycle comprising propane cooling equipment.

7. The system according to claim 6, wherein the cold box is a methane cold box, wherein the natural gas feed is configured to flow through the propane cooling equipment, then flow through the ethylene cold box, and then enter the methane cold box.

8. The system according to claim 5, wherein the cold box is a methane cold box, wherein the storage tank is located within the methane cold box, wherein the refrigerant is selected from ethane or ethylene, and wherein the storage tank is fluidically coupled to an inlet of the ethylene refrigerant cycle.

9. The system according to claim 6, wherein the cold box is a methane cold box, wherein the storage tank is located within the methane cold box, wherein the refrigerant is propane, and wherein the storage tank is fluidically coupled to an inlet of the propane refrigerant cycle.

10. The system according to claim 6, wherein:

the cold box is a methane cold box, a first storage tank and a second storage tank are located within the methane cold box, the first storage tank is configured to store propane and the first storage tank is fluidically coupled to an inlet of the propane refrigerant cycle, and the second storage tank is configured to store ethane or ethylene and the second storage tank is fluidically coupled to an inlet of the ethane or ethylene refrigerant cycle.

11. The system according to claim 6, wherein the cold box is the ethylene cold box.

12. The system according to claim 11, wherein the storage tank is located within the ethylene cold box, wherein the refrigerant is propane, and wherein the storage tank is fluidically coupled to an inlet of the propane refrigerant cycle.

13. The system according to claim 12, further comprising a methane cold box and wherein:

a first storage tank is located within the ethylene cold box, the first storage tank is configured to store propane and the first storage tank is fluidically coupled to an inlet of the propane refrigerant cycle, a second storage tank is located within the methane cold box, and the second storage tank is configured to store ethane or ethylene and the second storage tank is fluidically coupled to an inlet of the ethylene refrigerant cycle.

14. The system according to claim 1, further comprising a second storage tank, wherein the storage tank and the second storage tank are configured to store a refrigerant, and wherein the refrigerant is the same.

15. The system according to claim 14, further comprising a fluid communicator connector for connecting the storage tank and the second storage tank, wherein fluid communication and pressure communication occurs between the storage tank and the second storage tank.

16. The system according to claim 1, further comprising:

a refrigerant fill line coupled to the storage tank;

a refrigerant drain line coupled to the storage tank; and an inert gas inlet coupled to the storage tank.

17. The system according to claim 16, further comprising a pre-cooler coupled to the refrigerant fill line, wherein the pre-cooler is configured to decrease the temperature of refrigerant in the refrigerant fill line.

18. The system according to claim 16, further comprising a warmer coupled to the refrigerant drain line, wherein the warmer is configured to increase the temperature of refrigerant in the refrigerant drain line.

19. The system according to claim 1, wherein the storage tank is thermally coupled to at least one of the one or more natural gas cooling components via a convection connection or a conductive connection.

20. A method of processing natural gas into liquefied natural gas comprising:

supplying natural gas to a natural gas feed;

causing the natural gas to enter a cold box, wherein one or more natural gas cooling components and a storage tank are located within the cold box, wherein the storage tank houses a refrigerant, wherein the storage tank is thermally coupled to the one or more natural gas cooling components whereby the refrigerant is stored at a temperature below its boiling point when at a pressure of 1 atmosphere, wherein the one or more natural gas cooling components are part of a refrigerant cycle and wherein a mass of the refrigerant is required to fill the refrigerant cycle, and wherein the storage tank has a volume such that a mass of the refrigerant stored in the storage tank is greater than or equal to the mass of the refrigerant required to fill the refrigerant cycle; and decreasing the temperature of the natural gas to convert the natural gas to liquified natural gas.

* * * * *